US006726789B1

(12) United States Patent
Weihrauch

(10) Patent No.: US 6,726,789 B1
(45) Date of Patent: Apr. 27, 2004

(54) METHOD AND DEVICE FOR THE PRODUCTION OF BRUSHES

(75) Inventor: Georg Weihrauch, Wald-Michelbach (DE)

(73) Assignee: Coronet-Werke GmbH, Wald-Michelbach (DE)

( * ) Notice: Subject to any disclaimer, the term of this patent is extended or adjusted under 35 U.S.C. 154(b) by 0 days.

(21) Appl. No.: 09/914,450

(22) PCT Filed: Feb. 24, 2000

(86) PCT No.: PCT/EP00/01533

§ 371 (c)(1),
(2), (4) Date: Aug. 28, 2001

(87) PCT Pub. No.: WO00/51462

PCT Pub. Date: Sep. 8, 2000

(30) Foreign Application Priority Data

Mar. 4, 1999 (DE) ..... 199 09 435

(51) Int. Cl.[7] ..... A46D 1/08; A46D 3/05

(52) U.S. Cl. ..... 156/72; 300/2; 300/4; 300/8; 300/21

(58) Field of Search ..... 156/72, 297; 300/4, 300/2, 21, 7, 8

(56) References Cited

U.S. PATENT DOCUMENTS

| | | | |
|---|---|---|---|
| 5,249,327 A | 10/1993 | Hing | |
| 5,325,560 A | 7/1994 | Pavone et al. | |
| 5,431,484 A | 7/1995 | Zahoransky | |
| 5,728,408 A | 3/1998 | Boucherie | |

FOREIGN PATENT DOCUMENTS

| | | | |
|---|---|---|---|
| CA | 2163314 | * 6/1996 | ..... A46B/9/04 |
| DE | 16 04 673 | 10/1972 | |
| DE | 27 57 046 | 7/1979 | |
| DE | 35 05 972 | 8/1986 | |
| DE | 42 01 873 | 5/1993 | |
| DE | 94 08 268 | 7/1994 | |
| DE | 43 02 870 | 8/1994 | |
| DE | 43 17 453 | 12/1994 | |
| DE | 44 41 985 | 5/1996 | |
| DE | 44 44 926 | 6/1996 | |
| DE | 196 16 309 | 10/1997 | |
| EP | 07 16 821 | 6/1996 | |
| WO | WO 96 16 571 | 6/1996 | |

* cited by examiner

*Primary Examiner*—Jeff H. Aftergut
*Assistant Examiner*—Todd J Kilkenny
(74) *Attorney, Agent, or Firm*—Paul Vincent

(57) ABSTRACT

In a method for the production of brushes consisting of a bristle support and bristles mounted thereon and combined to at least one group having a defined cross-section with at least two different types of bristles, the bristles of a bristle type are combined into a partial group and the partial groups forming a bristle group are combined into said bristle group and subsequently, the bristle group is mounted to the bristle support. The bristles of each partial group are formed in a surrounding guide of a shaping device into a cross-section corresponding to their partial cross-sections in the bristle group, and the partial groups are then combined while maintaining their partial cross-section in the guides to form the cross-section of the bristle group. A device for carrying out this method and brushes produced in this fashion are also described.

24 Claims, 9 Drawing Sheets

METHOD AND DEVICE FOR THE PRODUCTION OF BRUSHES

BACKGROUND OF THE INVENTION

The invention concerns a method for the production of brushes, consisting of a bristle support and bristles of at least two different bristle types which are fastened thereto and combined to at least one group having a defined cross-section by uniting the bristles of one bristle type to form a partial group and the partial groups forming the bristle group are combined in converging guides to form the bristle group, wherein the bristle group is subsequently attached to the bristle support. The invention also concerns a device for carrying out the method.

Conventional brushes consist of a bristle support and bristles fastened thereon which are usually combined to form bristle groups, e.g. bundles. The bristle groups are mounted to the bristle support either mechanically, using the so-called punching method, or, if the bristles and bristle supports are made from plastic, more recently using a thermal process, in optional combination with a mechanical deformation method. Such recent methods include welding of the bristles onto the surface of the bristle support, inserting the bristle bundles into a bristle support surface which is melted to a greater or lesser extent or injection molding the bundle by melting the bristle ends at the bundle foot to form an enlargement and extruding bristle support material around this area. These thermal methods have been used, in particular, for tooth brushes, hygiene brushes etc.

The selection of bristles with regard to material, cross-section and length depends largely on the intended use of the brush. The arrangement and number of bristles in a bundle, the arrangement and shape of the bundles themselves or of the bristles which are combined into groups vary in dependence on the intended use. The term brushes also includes brush-like devices for applying media, wherein the bristles are generally disposed in one group only, i.e. a bundle, a package or the like.

As has been known in the art for some time, tooth brushes having a straight cut brush stock, i.e. with all bristle ends disposed in one plane, do not satisfy dental hygienic requirements, since the curved as well as uneven tooth surfaces and the interdental spaces are not adequately cleaned. For these reasons, tooth brushes were developed having bristle ends lying in envelope surfaces contoured to a greater or lesser degree, by e.g. providing the bristle stock with a wavy cut. There are also conventional brushes which have the ends of bristles of an individual bundle disposed on a conical surface. All these measures are intended to assure that the bristles reach into the interdental spaces.

Dental medical evaluations of such tooth brushes have, however, shown that the tips of individual bundles or the apex of a wavy cut are unacceptably aggressive on the smooth tooth surfaces and leave grinding traces on the enamel. They can also lead to injury of the gum and gingiva which causes discomfort, especially with sensitive gums.

These disadvantageous consequences can be alleviated, but not eliminated, by a conventional tooth brush (WO 96/16571). Its bristle stock consists of individual bundles whose ends lie in a conical surface having the above mentioned aggressive tip. Moreover, each bundle contains individual bristles which are longer than the other bristles in the bundles and whose ends are disposed in one single plane. These individual bristles thereby slightly protrude past the bundled bristles. This configuration is intended to improve cleaning of the interdental spaces, since the individual bristles can more easily access such areas compared to conical bundles. These brushes are difficult to manufacture, since the individual bristles have to be drawn into the bundles in a separate processing step.

Macroscopic studies have shown that the tooth surfaces have fine cracks into which conventional bristles, due to their diameter, cannot enter and which are therefore not cleaned. Thinner, fiber-like bristles (DE 94 08 268 U1) which are wrapped in an enclosed envelope, with only the ends protruding past the wrapping, were proposed for cleaning and gentle treatment of the gums. These thin fibers fold down outside the wrapping envelope and have almost no effect. In addition, the sharp envelope edge increases the danger of injury to the gums and gingiva as well as possible damage to the tooth surface due to grinding traces. This conventional tooth brush is also very difficult to manufacture.

With tooth brushes and also with other brushes, such as paint brushes and the like, the bristle groups must be arranged in defined geometrical shapes and different types of bristles must be inserted into the bristle stock or individual bristle groups forming same to achieve the effects required for the respective application. DE 16 04 673 discloses bundles having differing cross-sectional shapes and DE 35 05 972 discloses combining the bristle stock of differently shaped bundles. These different bundle shapes are generated by rolling endless monofilaments to form a cord, wherein each cord consists of a number of monofilaments corresponding to the number of bristles in a bundle. The monofilament cord is pulled or pushed through a shaping device which forms the cord, of irregular cross-sectional shape, into the desired cross-sectional shape. Downstream of the shaping device, the bundles are cut to the desired length and fastened to the bristle support. This only allows variation of the bundle shape.

DE 196 16 309 suggests the production of bundles of bristles of different types by winding together endless monofilaments of various types to form a cord, from which individual bundles are cut. In this case, different types of bristles are present within the bundle in a static, uniform distribution. The various bristles are not distributed and arranged in dependence on the application. EP-A1-0 716 821 discloses tooth and body care brushes with which the bristles are collected into groups containing different kinds of bristles.

In conventional brushes having injection molded bundles (U.S. Pat. No. 5,728,408) the bristles, cut to bundle length, are removed from a magazine using punching tubes and inserted in bundle channels of an injection molding form and into the mold cavity. Several bundles of circular cross-section can thereby be combined via converging channels, next to one another, into stripe-shaped bristle groups having a width corresponding to the bundle diameter. Neighboring bundles may comprise various bristles disposed next to one another in the stripe-shaped bristle group. The various types of bristles thereby disadvantageously mix in the transition area between neighboring bundles and are not effective in this area. Since bristles of various types are adjacent to one another in the stripe-shaped bristle group and are used in the same manner during brushing, both types of brushes display differing signs of premature wear.

It is the underlying purpose of the invention to further develop the conventional method of U.S. Pat. No. 5,728,408 according to the preamble of claim 1 in such a manner that brushes can be produced in any form and in dependence on the intended use which have bristle groups consisting of partial groups of various cross-sections, with bristles of different types and different numbers in the partial groups.

SUMMARY OF THE INVENTION

This object is achieved in accordance with the invention in that the bristles of each partial group are shaped in a surrounding shaping device guide to obtain a cross-section corresponding to their partial cross-section in the bristle group and the partial groups are then combined in the guides to obtain the cross-sectional shape of the bristle group. Preferably, the bristle group is then transferred to a holding means to transport the bristle group for fastening to the bristle support. The finished bristle group can also be attached to the bristle support directly after shaping.

The method according to the invention permits production of a bristle group of defined cross-section from partial groups of various bristle types also having defined partial cross-sections such that the various types of bristles are present within the bristle group in a defined geometrical shape optimally adapted to the respective use of the brush. With this geometrical shape generated by the shaping device, the bristle groups or the partial groups forming same may be subsequently fixed in the holding means and fastened to the bristle support using conventional mechanical or thermal methods while maintaining this geometrical shape. The inventive method can generate bristle groups of arbitrary cross-section within which the partial groups of arbitrary cross-section are arranged to always optimize the respective intended use. The partial groups may thereby be arranged e.g. concentrically, in the form of segments, sectors or stripes. The invention permits different numbers of bristles to be used in each partial group.

Preferably, the bristles of each partial group are compressed during shaping into close proximity to one another and support each other within the partial group. This dense packaging of bristles is particularly advantageous for thermal fastening of the bristle group on the bristle support, since the softened plastic mass of the bristle support cannot enter between the bristles.

With the method in accordance with the invention, all groups of bristles in the bristle stock of the brush can be simultaneously or sequentially formed in the shaping device. In either event, they can be passed on to a holding means accepting all bristle groups for attaching the complete bristle stock to the bristle support.

In a preferred embodiment, the partial groups, after being combined to form a bristle group, are transferred, with different lengths, to the holding means and are cut flat at a location between the shaping device and the holding means.

This allows the useful ends of the partial groups forming the bristle groups to be disposed in different planes such that their different characteristics can be simultaneously effective during brushing.

The bristle groups are preferably clamped in the holding means to fix the geometrical shape generated by the shaping device.

This allows, in particular, the useful ends of the bristles of the bristle groups clamped in the holding means to be mechanically treated, e.g. rounded, and also facilitates preparation of their opposite ends for mounting to the bristle support: e.g. to melt them into a bundle foot, to shape them, or to size them.

In the unclamped state, the holding means also permit axial displacement of the bristles therein relative to one another to bring the useful ends of each partial group into different envelope surfaces. These surfaces may be curved in a smooth or non-smooth manner.

The method according to the invention permits the partial groups to be in close proximity to each other during formation of a bristle group and to be tightly packed together to form a bristle group with defined, bordering surfaces always being located between the partial groups.

In a preferred embodiment, the bristles of the partial groups are made from endless monofilaments by accommodating bristles of the same type, in the form of endless monofilament cords, on separate spools, removing the cords of bristles from the spools and introducing them into the guides to form one partial group each, wherein the bristles of all partial groups forming a bristle group are simultaneously supplied to the guides. The cords forming the partial groups may have different amounts of endless monofilaments.

The partial groups may also be made from short-cut bristles of appropriate length.

The invention further concerns a device for carrying out the method according to the invention. A device of this type forms a bristle group comprising at least two partial groups of different type bristles, by providing at least one spool with a cord of monofilaments having the same type of bristle, for each partial group, and with at least one drawing device, disposed downstream of the spool, with one guiding channel for each cord and, downstream of the drawing device, a stationary shaping device having a corresponding number of shaping channels whose openings facing the drawing devices are aligned with the guiding channels, wherein the opening thereof has a cross-sectional shape that varies into the partial cross-section of the partial group and simultaneously converges towards an envelope cross-section corresponding to the cross-section of the bristle group. A moveable holding means for the bristle group is advantageously disposed downstream of the shaping device having holding channels whose shape and arrangement correspond to those of the guiding channels of the drawing device facing same, wherein the cords can be removed from the spools by the linearly moveable drawing device, and can be pushed through the shaping device and optionally transferred to the downstream holding means, and further comprising a cutting device, disposed between the shaping device and the holding means, for cutting the bristle group, located in the holding means, to a desired length, wherein, the holding means with the bristle group can be moved for mounting the bristle group to the bristle support.

The device according to the invention cyclically produces the bristle groups, or the entire bristle stock, from several bristle groups which are then fastened to the bristle support or transported by the holding means to be fastened thereto.

The shaping channels of the shaping device can simultaneously taper in the direction of their cross-sectional variation such that the bristles of the partial group are simultaneously compressed during shaping.

In a preferred embodiment, at least two separately movable drawing devices are disposed one after the other, which, either individually or collectively, cooperate with the cords forming the partial groups to insert the partial groups into the holding means to the same or differing extents.

In this manner, partial groups of differing lengths can be easily made within one bristle group.

The drawing device and the holding means preferably comprise parallel layered plates, one of which is a clamping plate which can be moved transverse to the guiding or holding channels.

With the inventive device, the holding means with the clamped bristle group can be transported to a processing device and/or a device for treatment of the useful bristle ends and/or of the bristle ends which are to be mounted, before the bristle group or the bristle stock, consisting of several bristle groups, is fastened to the bristle support.

The method and device in accordance with the invention facilitate production of brushes having a bristle stock formed from bristle groups of defined cross-sectional shapes and having at least two partial groups of bristles of various types with complementary cross-sectional shape, wherein flat or curved bordering surfaces are formed between the at least two partial groups of a bristle group. Undefined mixing of the various bristle types is prevented and the partial groups are disposed within each bristle group in defined geometrical shape.

The at least one partial group of a bristle group may thereby surround the other partial group, e.g. two partial groups can be disposed concentric to one another. Several partial groups of a bristle group can also surround a central partial group in a concentric fashion.

The at least two partial groups of a bristle group can consist of bristles of various cross-sections, various cross-sectional shapes, various materials, various material compositions or material characteristics, various surface conditions or various colors.

A preferred embodiment provides that the partial group within a bristle group consists of bristles having a lower flexural strength that that of the bristles in the partial group(s) surrounding this partial group. In this way the inner, softer, e.g. thinner bristles are supported from all sides along at least part of their length.

In each bristle group of this embodiment, the partial group of the bristles having the lower flexural strength can protrude past the ends of the surrounding bristles having the higher flexural strength.

Bach bristle group can have the ends of partial group bristles disposed in flat, optionally differing envelope surfaces or in curved envelope surfaces and, optionally, in envelope surfaces of various curvatures.

The ends of the bristles of all partial groups of a bristle group are preferably disposed in a smoothly curved envelope surface which, in a further advantageous embodiment, is symmetric with respect to an axis extending parallel to the bristles of the bristle group.

The invention is described below with embodiments shown in the drawing.

DESCRIPTION OF THE PREFERRED EMBODIMENT

Figures 1, 2, 3, 4, 5, 6:
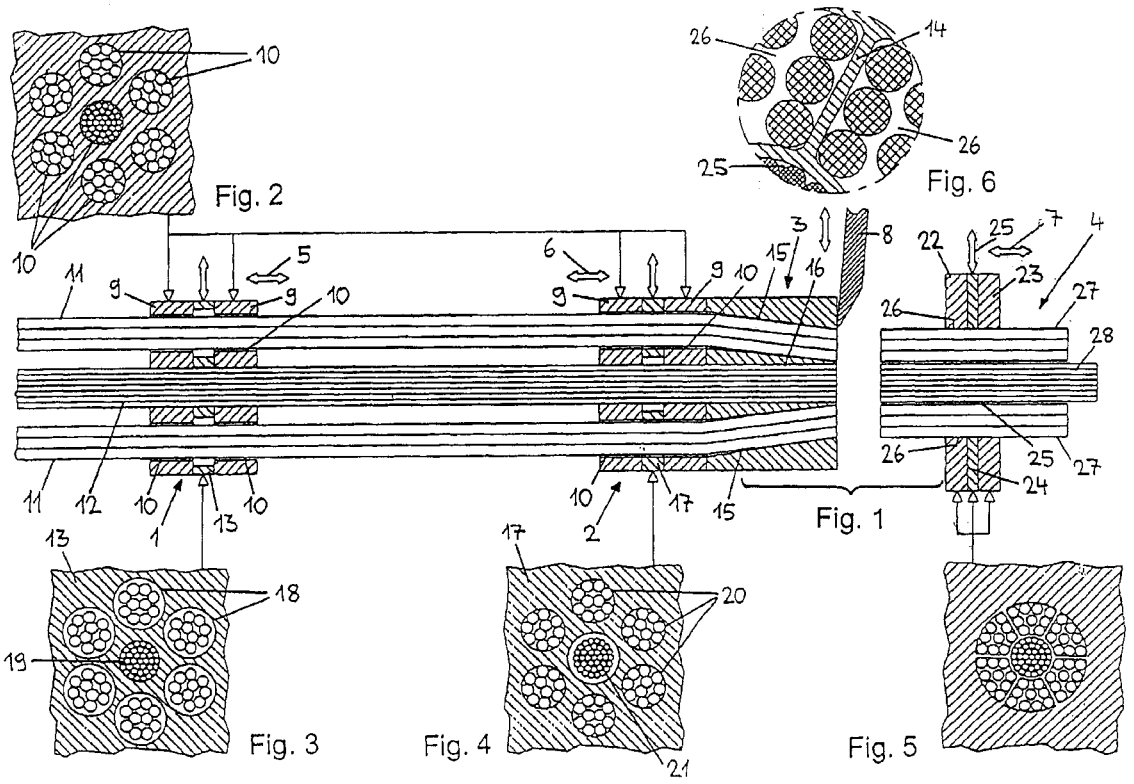
FIG. 1 shows a schematic side view of the device for carrying out the method.
FIG. 2 shows a first section of the device of FIG. 1.
FIG. 3 shows a second section of the device of FIG. 1.
FIG. 4 shows a third section of the device of FIG. 1.
FIG. 5 shows a fourth section of the device of FIG. 1.
FIG. 6 shows a fifth section of the device of FIG. 1.
Figure 7:
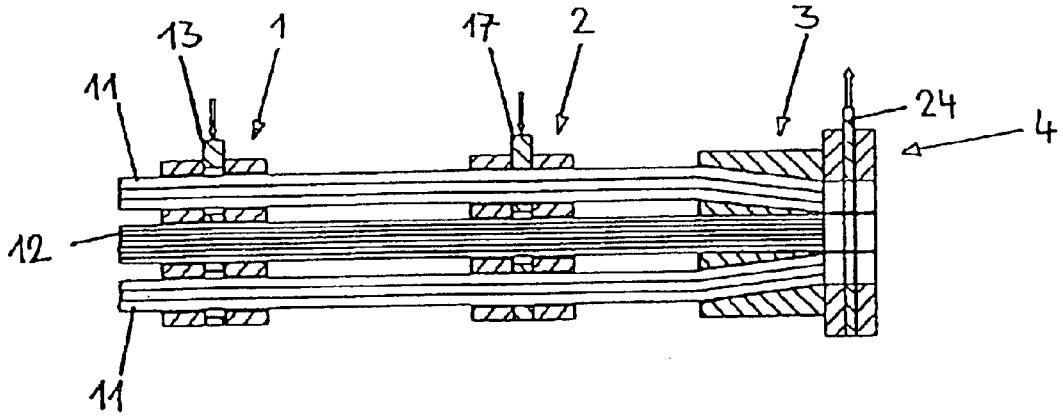
FIG. 7 shows the device of FIG. 1 in a first stage of the method.
Figure 8:
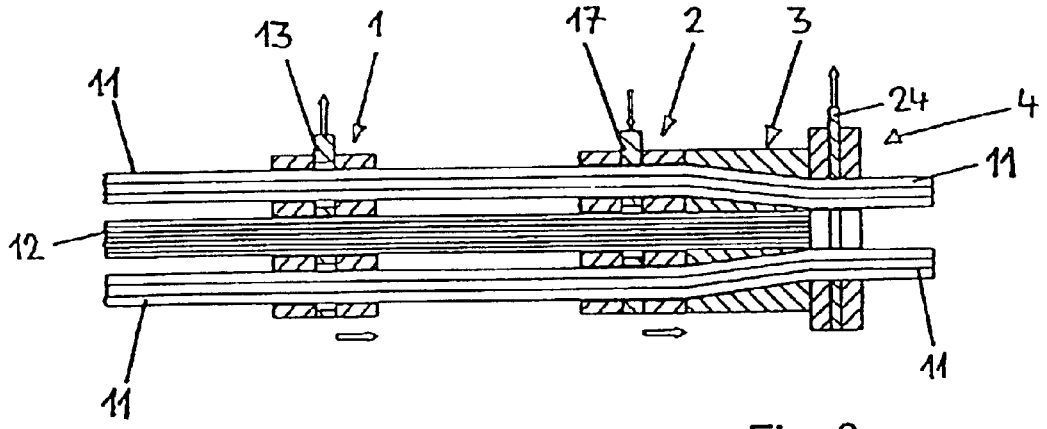
FIG. 8 shows the device of FIG. 1 in a second stage of the method.

The device shown in FIG. 1 serves for the production of bristle groups from partial groups of various types of bristles, wherein the bristles of each partial group are combined from endless monofilaments into a cord and e.g. disposed on spools from which they are removed by the device according to FIG. 1 and processed into bristle groups. The device in the embodiment shown comprises two drawing devices 1,2, disposed one after the other, a shaping device 3 disposed downstream of the drawing device 2 and a holding means 4 disposed downstream of the shaping device 3. The drawing devices 1 and 2 can be linearly displaced in the direction of the double arrows 5 and 6, respectively, whereas the shaping device 3 is stationary. The holding means 4 can be moved in accordance with the double arrow 7. The embodiment shown also comprises a cutting device 8 downstream of the shaping device 3.

The device according to FIG. 1 serves for the production of a bristle group comprising a central partial group and six partial groups enclosing same (see FIG. 5). Each drawing device 1 comprises two outer plates 9 with a total of seven guiding channels 10, each for an external cord 11, and a central cord 12. The external cords 11 consist of one single bristle type, e.g. of bristles having a relatively large cross-section, whereas the central cord 12 consists of endless monofilaments of a smaller cross-section. The cords 11, 12 are guided with play in the guiding channels 10 of the two outer plates 9. The drawing device 1 comprises a clamping plate 13 between the two plates 9 which can be displaced transversely to the cords 11, 12, as shown by the double arrow.

The drawing device 2 likewise comprises external plates 9, 9 with guiding channels 10 and a central clamping plate 17. The clamping plate 13 has channels 18 of larger cross-section which are aligned with the guiding channels 10, and a central guiding channel 19 of smaller cross-section (FIG. 3). The clamping plate 17 has channels 20 aligned with the guiding channels 10, for the cords 11 of identical cross-section, and a central channel 21 of larger cross-section (FIG. 4).

The shaping device 3 has a number of shaping channels 15, 16 which corresponds with the number of guiding channels of the drawing device 1, 2. The shaping channel 16 is aligned with the central channel of the drawing devices 1, 2, and the openings in the peripheral shaping channels 15 facing the drawing device 2 are aligned with the guiding channels 10. The shaping channels 15 converge towards the central shaping channel 16 at the opposing side openings. Shaping channel 16 has a constant circular cross-section. The cross-sections of the peripheral shaping channels 15 vary in the direction of their conversion from a circular cross-section at the inlet opening to a circular sector shaped cross-section at the opposing opening.

The holding means 4 is structured as a clamping device. It comprises two external plates 22, 23 and a central clamping plate 24 which can be displaced in the direction of the double arrow 25. The holding means 4 comprises a central holding channel 25 which is closely surrounded by peripheral holding channels 26 which are disposed with respect to one another in the same manner as the shaping channels 15 and 16 at the opening facing the holding means 4. As shown in FIG. 6, narrow braces 14 are disposed between the peripheral holding channels 26 and between these channels and the central holding channel 25.

FIGS. 7 to 12 describe operation of the device. At the start of operation, the cords 11 and 12 are inserted at the drawing devices 1 and 2 into the shaping device 3 with the clamping plates 13, 17 open. This shapes the leading ends of the cords 11, 12 in the shaping device to achieve the corresponding partial cross-sections of the partial groups. During the first operating cycle, the clamping plate 17 is closed, thus clamping the outer cords 11. The clamping plate 13 remains in its open position. The drawing devices 1 and 2 then move towards the right (FIG. 8) until the cords 11 have been pushed through the holding means 4, the clamping plate 24 of which is also in the open position, such that the cords 11 protrude past the holding means 4. The drawing device 2 thereby abuts against shaping device 3.

Figure 9:
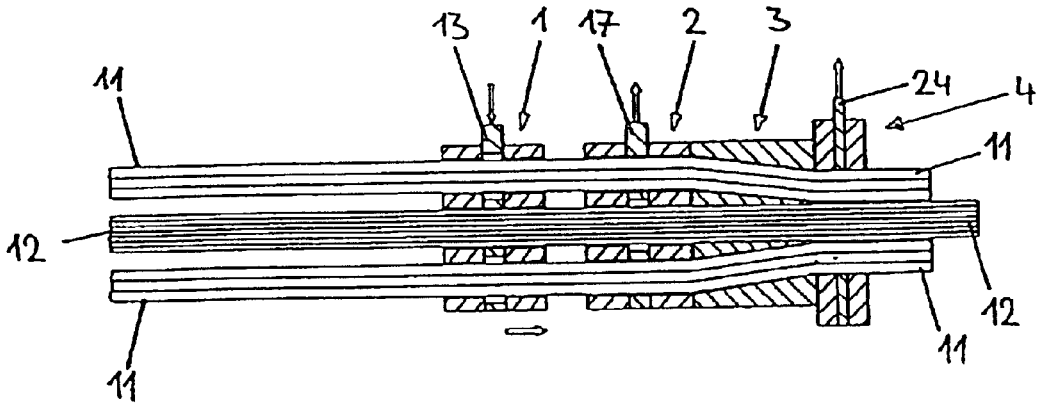
FIG. 9 shows the device of FIG. 1 in a third stage of the method.
Figure 10:
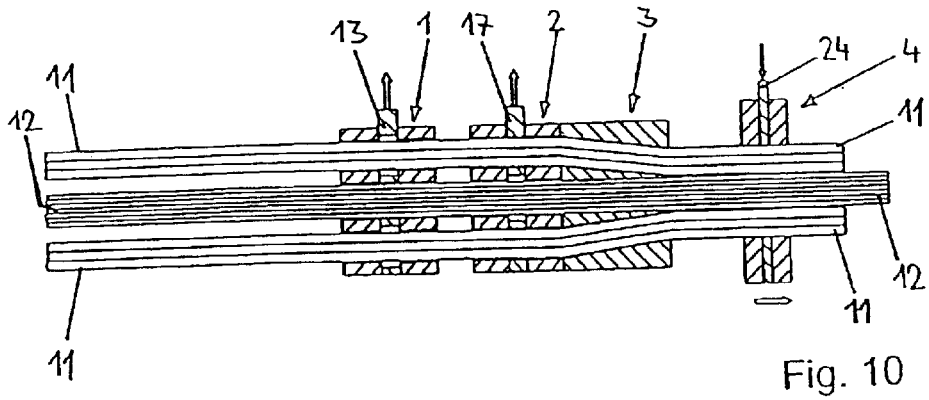
FIG. 10 shows the device of FIG. 1 in a fourth stage of the method.
Figure 11:
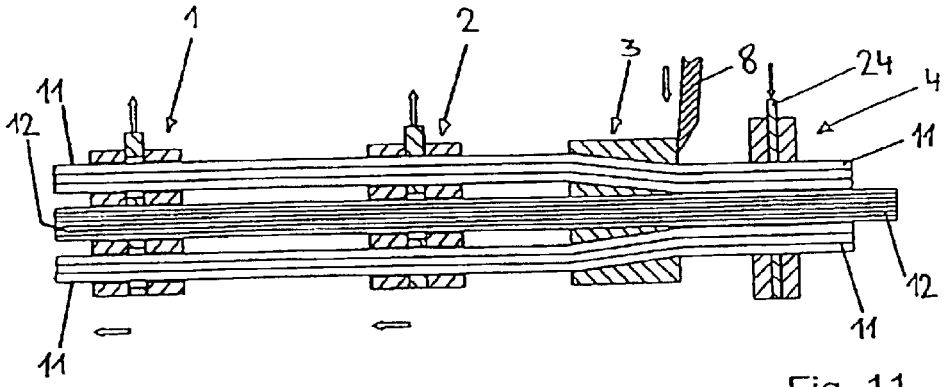
FIG. 11 shows the device of FIG. 1 in a fifth stage of the method.
Figure 12:
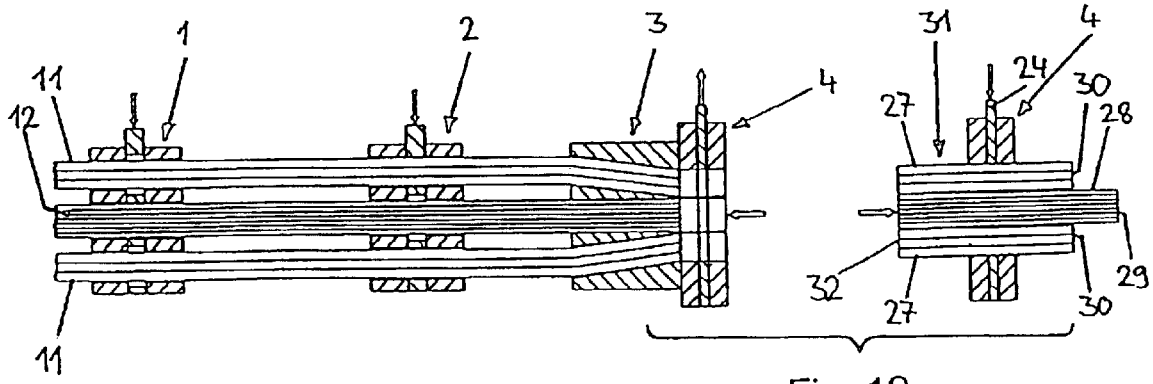
FIG. 12 shows the device of FIG. 1 in a sixth stage of the method.
Figure 13:
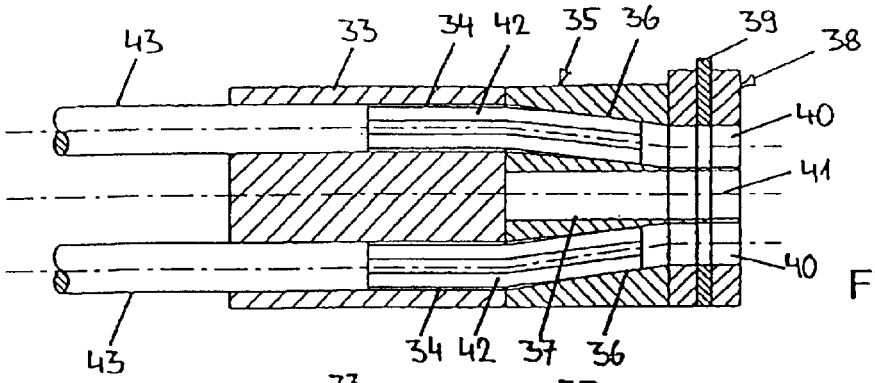
FIG. 13 shows a first view of a further embodiment of a device for carrying out the method.

The clamping plate 17 of the drawing device 2 is then opened and the clamping plate 13 of the drawing device 1 is closed and drawing device 1 is moved towards drawing device 2 (FIG. 9). The drawing device 1 carries only the central cord 12 for the central partial group of the bristle group and pushes it through the shaping device 3 and the holding means 4 until its leading end protrudes past the cords 11 already disposed in the holding means. The clamping plates 13, 17 are then opened to release the cords in the drawing devices 1 and 2. The holding means 4 is moved away from the shaping device 3 with the clamping plate 24 closed and thereby pulls the cords 11, 12 through the shaping device 3 (FIG. 10). The cutting device 8 is then lowered in front of the shaping device 3 to cut the cords clamped within the holding means 4 at the shaping device 3 (FIG. 11). The holding means 4 fixes a bristle group (FIG. 12) consisting of outer partial groups 27 and a central partial group 28 whose cross-section and correlation with respect to one another is shown in FIG. 5. A new holding means 4 is then disposed in front of the shaping device 3 (FIG. 12), the drawing devices 1 and 2 are withdrawn and a new working cycle starts as delineated with reference to FIG. 7.

The holding means 4 can then be transported to processing stations to e.g. treat the useful ends 29 of the partial group 28 and the useful ends 30 of the partial group 27 (e.g. round them off). The partial groups may also be displaced axially with respect to one another after releasing the clamping plate 24 to dispose the useful ends 29,30 in any desired envelope surface. The opposing ends 32 of the entire bristle group 31 may also be processed for mounting to the bristle support. For example, the ends may be melted together, shaped or sized.

Figure 14:
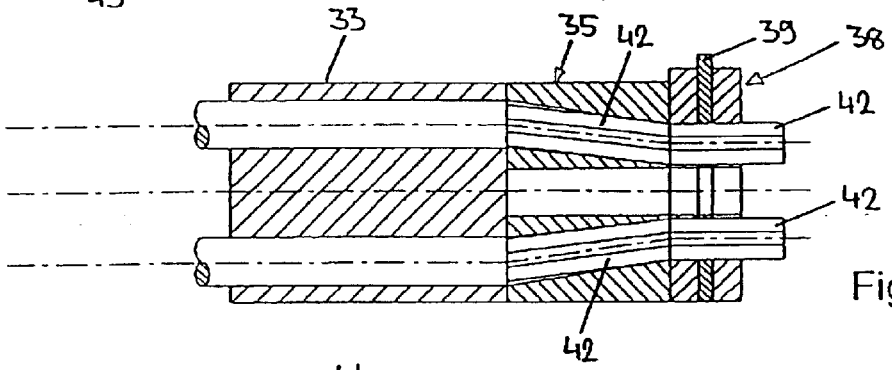
FIG. 14 shows a second view of the further embodiment.
Figure 15:
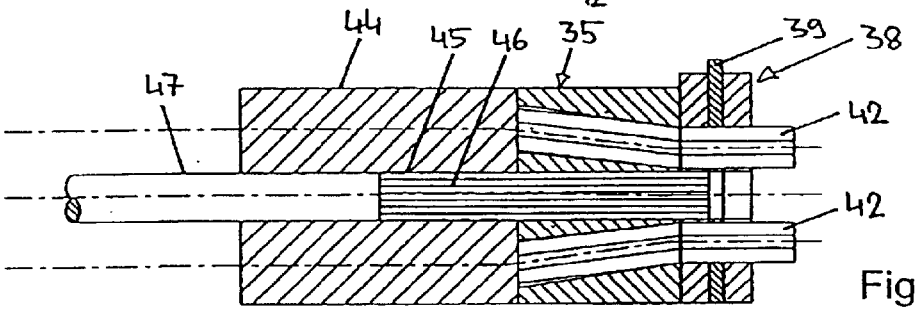
FIG. 15 shows a third view of the further embodiment.
Figure 16:
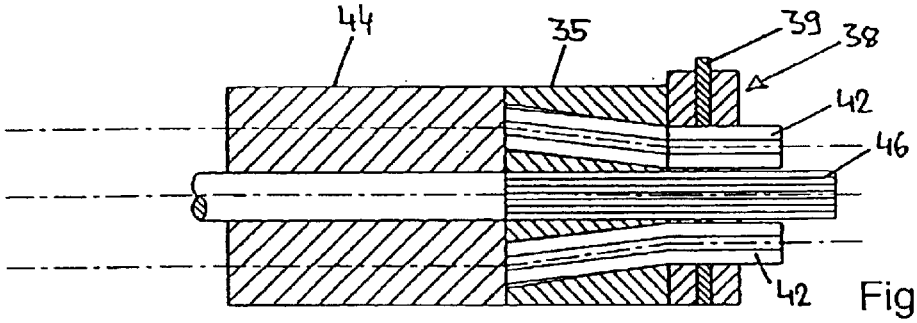
FIG. 16 shows a fourth view of the further embodiment.
Figure 17:
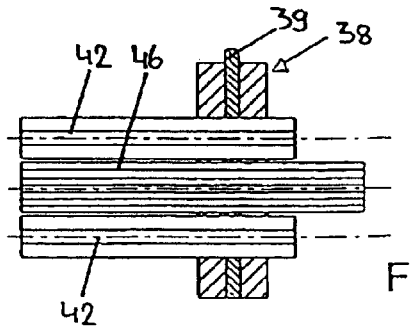
FIG. 17 shows a fifth view of the further embodiment.

The device according to FIGS. 1 to 12 processes endless monofilaments. The device of FIGS. 13 to 17 processes so-called short cuts, wherein the partial groups forming the bristle group are already cut to the required length. This latter device comprises a guiding block 33 having guiding channels 34 followed by a shaping device 35 with converging shaping channels 36 and a central shaping channel 37. The shaping channels 36 have cross-sectional shapes which change in the direction of conversion. The shaping device 35 is followed by a holding means 38 comprising a central clamping plate 39. The holding means 38 has peripheral holding channels 40 and a central holding channel 41 which are aligned with the openings of the shaping channels 36 and 37 facing the holding means. The short cuts 42, each constituting one peripheral partial group within the bristle group, are inserted into the guiding channels 34 of the guiding block 33 and displaced into the shaping channels 36 of the shaping device 35 via punches inserted into the channels 34 until they finally pass through and protrude past the front of the holding means 38 (FIG. 14). The guiding block 33 is then removed and a guiding block 44 with a central guiding channel 45 is disposed in front of the shaping device 38 for a short cut 46 forming the central partial group (FIG. 15). The short cut 46 is displaced by a punch 47 through the shaping device into the holding means 38 until the short cut 46 forming the central partial group protrudes past the short cuts 42 forming the peripheral partial groups (FIG. 16). The holding means 38 is then removed from the shaping device 35 with the clamping plate 39 closed, and the short cuts 42, 46 are removed from the shaping device 35 (FIG. 17).

The devices according to FIGS. 1 to 12 and 13 to 17, respectively, can produce bristle groups of differing geometrical shapes. Some embodiments are described below.

Figure 18:
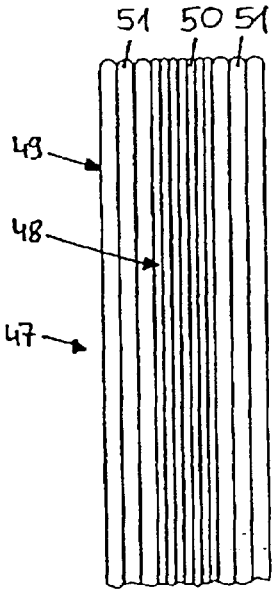
FIG. 18 shows a schematic side view of a longitudinal section of a first embodiment of a bristle group.
Figure 19:
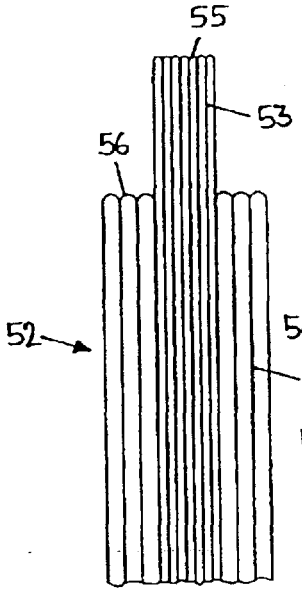
FIG. 19 shows a schematic side view of a longitudinal section of a second embodiment of a bristle group.
Figure 22:
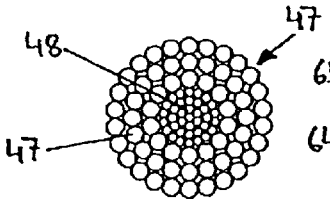
FIG. 22 shows a top view of a bristle group comprising a first partial group.

FIG. 18 shows a side view of a bristle group 47 consisting of partial groups as shown in FIG. 5 or only of one central partial group 48 and one surrounding partial group 49 enclosing the complete circumference thereof as shown e.g. in FIG. 22. In this embodiment, the partial group 48 consists of small diameter bristles and the surrounding bristle group 49 comprises bristles of a larger diameter. The ends 50 of the central partial group 48 and the ends 51 of the central partial group 48 and the ends 51 of the surrounding partial group 49 lie in one plane. FIG. 19 shows a bristle group 52 of a central partial group 53 and an outer partial group 54 which surrounds same concentrically, wherein the ends 55 of the partial group 53 and also the ends 56 of the partial group 54 lie in flat envelope surfaces disposed at different heights.

Figure 20:
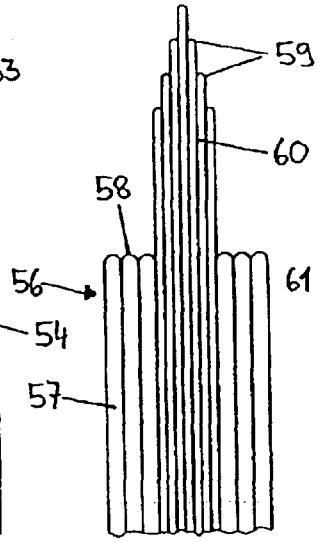
FIG. 20 shows a schematic side view of a longitudinal section of a third embodiment of a bristle group.
Figure 21:
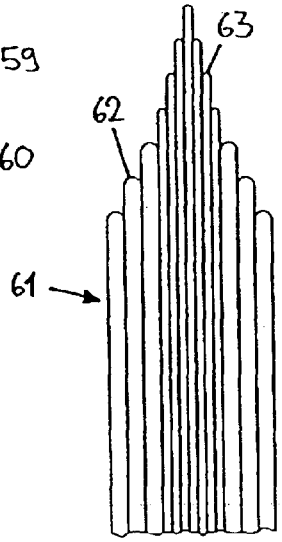
FIG. 21 shows a schematic side view of a longitudinal section of a fourth embodiment of a bristle group.

The bristle group 56 according to FIG. 20 differs from the one shown in FIG. 19 in that the ends.59 of the central partial group 60 are disposed on a conical surface while the ends 58 of the surrounding partial group 57 are again disposed in a plane. Finally, FIG. 21 shows a bristle group 61, wherein the ends 62 of the surrounding bristle group and the ends 63 of the central bristle group are disposed on a common conical surface.

Figure 23:
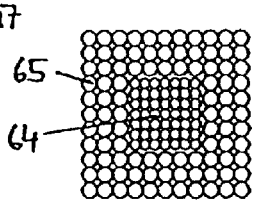
FIG. 23 shows a top view of a bristle group comprising a second partial group.
Figure 24:
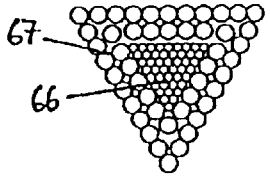
FIG. 24 shows a top view of a bristle group comprising a third partial group.
Figure 25:
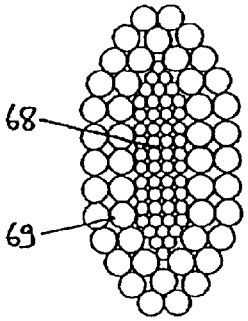
FIG. 25 shows a top view of a bristle group comprising a fourth partial group.

FIG. 22 has already been discussed in connection with FIG. 18. In the embodiment of FIG. 23, the circumference of a central partial group 64 having bristles of smaller diameter is completely enclosed by a bristle group 65 having bristles of larger diameter, wherein both partial groups have a square cross-section. The embodiment according to FIG. 24 differs in that the central partial group 66 has a triangular cross-section and the partial group 67 surrounding it also has a triangular shape. FIG. 25 shows an embodiment having a central partial group 68 of approximately oval cross-section which can optionally also be formed of several partial groups and comprises bristles of smaller cross-section, whereas the outer partial group 69 surrounding same, which can also consist of several partial groups, comprises bristles of a larger cross-section.

Figure 26:
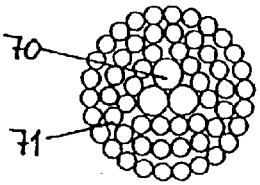
FIG. 26 shows a top view of a bristle group comprising a fifth partial group.
Figure 27:
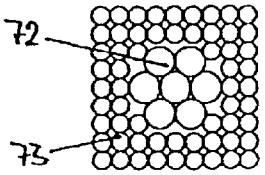
FIG. 27 shows a top view of a bristle group comprising a sixth partial group.

FIG. 26 shows a bristle group comprising a central partial group 70 of only a few bristles of large diameter and a partial group 71 surrounding same, which can also be formed from several partial groups, containing bristles of smaller diameter. The bristle group according to FIG. 27 differs in shape from the circular cross-section of the bristle group according to FIG. 26 in that the central partial group 72 is again approximately circular, whereas the outer partial group 73 is square.

Figure 28:
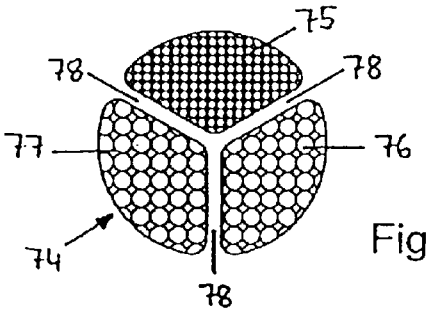
FIG. 28 shows a top view of a bristle group comprising a seventh partial group.
Figure 29:
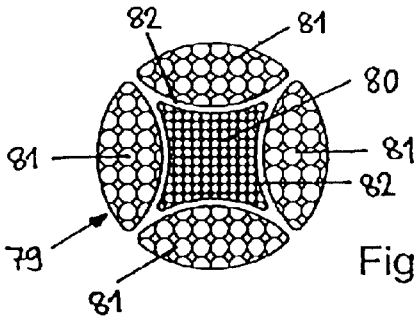
FIG. 29 shows a top view of a bristle group comprising an eighth partial group.

FIG. 28 shows a bristle group 74 consisting of three partial groups 75, 76 and 77 comprising partial cross-sections having a circular sector shape which are complementary to form a circular cross-section of the bristle group 74, wherein the groups are separated from one another by planar bordering surfaces 78. The partial group 75 comprises bristles of smaller diameter than the partial groups 76 and 77. FIG. 29 shows a bristle group 79 consisting of a central partial group 80 with approximately rhombus-shaped cross-section and four surrounding partial groups 81 of lens-shaped cross-section. The central partial group 80 comprises bristles of smaller diameter and the surrounding lens-shaped partial group 81 contains bristles of the same and larger diameters. Curved bordering surfaces 82 are disposed between the central partial group 80 and the outer partial groups 81.

Figure 30:
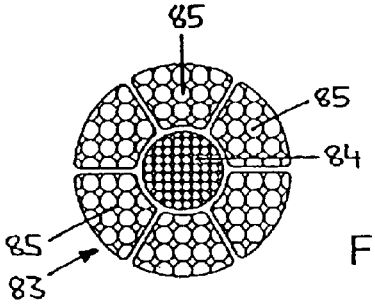
FIG. 30 shows a top view of a bristle group comprising a ninth partial group.

FIG. 30 shows a bristle group 83 having a central partial group 84 with circular cross-section and six surrounding partial groups 85 of sector-shaped cross-section. The production of this bristle group 83 has been explained with reference to FIGS. 1 to 5.

Figure 31:
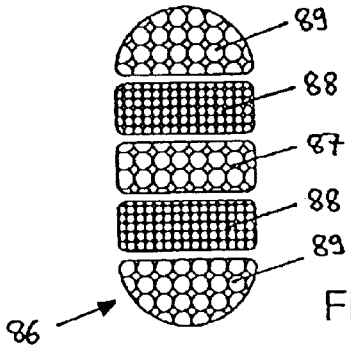
FIG. 31 shows a top view of a bristle group comprising a tenth partial group.

The bristle group 86 according to FIG. 31 consists of a central partial group 87 and neighboring partial groups 88 of essentially square cross-section, wherein the central partial group 87 comprises bristles of larger diameter. Partial groups 89 having an essentially semi-circular cross-section and containing e.g. bristles of the same diameter as the central partial group 87 are outwardly adjacent to the two partial groups 88.

Figure 32:
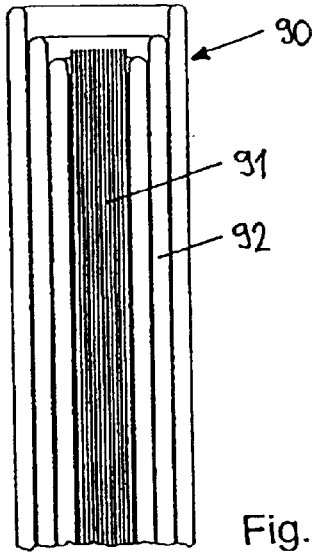
FIG. 32 shows a side view of a bristle group comprising two partial groups.
Figure 34:
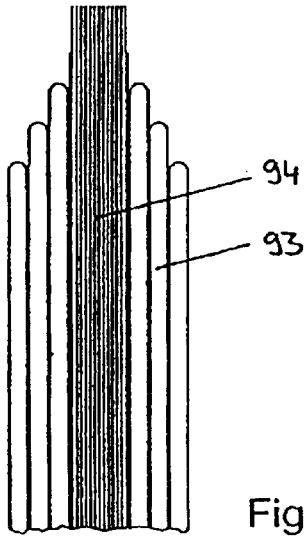
FIG. 34 shows a side view of a bristle group with two partial groups in a different embodiment.
Figure 33:
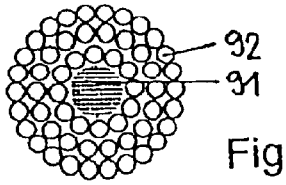
FIG. 33 shows a top view of the bristle group of FIG. 32.
Figure 35:
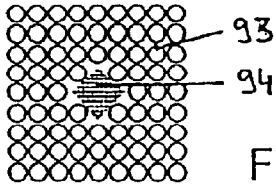
FIG. 35 shows a top view of the embodiment according to FIG. 34.

FIGS. 32 and 33 show a bristle group 90 having an inner partial group 91 and a surrounding partial group 92 of circular cross-section, wherein the inner partial group 91 consists of extremely thin bristles and the outer partial group 92 consists of bristles of a larger cross-section which support the bristles of the inner partial group 91 at all sides. The embodiment according to FIGS. 34 and 35 differs from the one shown in FIGS. 32 and 33 in that the outer partial group 93 and the inner partial group 94 each have a square cross-section and the thin bristles of the inner partial group 94 protrude upwardly past the bristles of the outer partial group 93.

Figure 36:
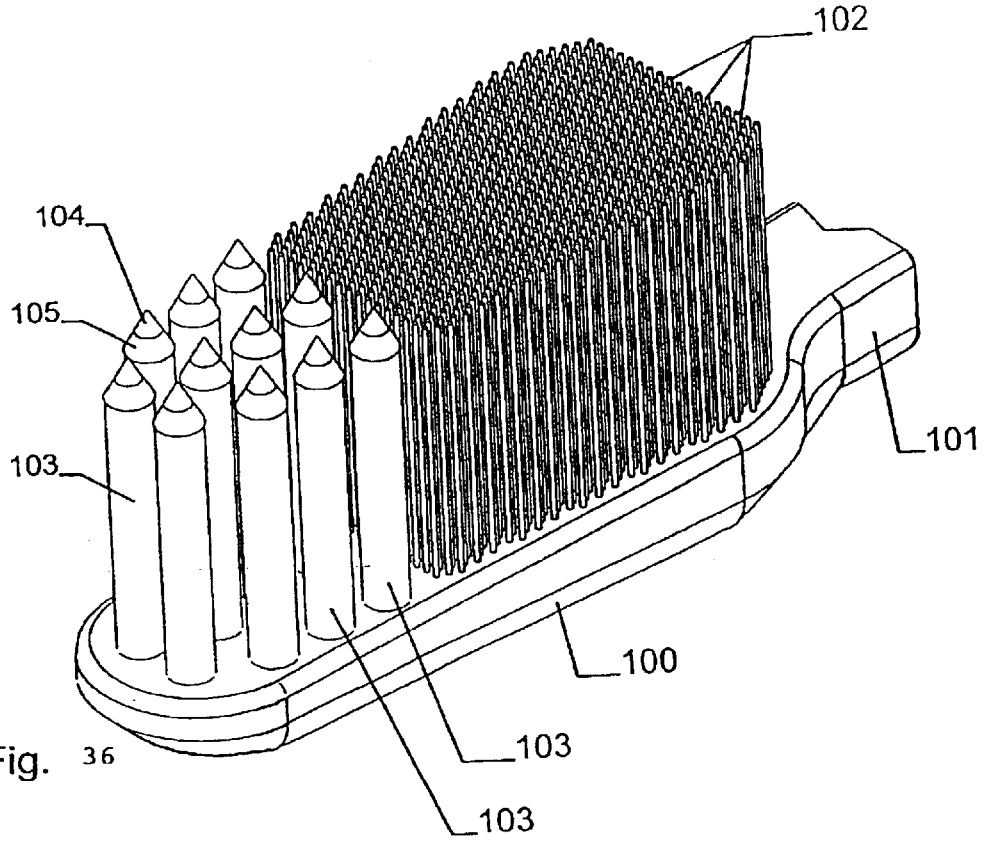
FIG. 36 shows a perspective partial view of a tooth brush head.

The embodiment of FIG. 36 shows how a bristle stock may be configured, e.g. for a tooth brush. Only the head 100 and part of the neck 101 are shown. A field of bristle stock comprising individual standing bristles 102 is mounted to a relatively large surface of the head 100, proximate the neck 101. The front area of the brush head 100 is provided with individual bristle groups 103 having an essentially circular cross-section. Each bristle group 103 consists of an inner partial group 104 and an outer partial group 105 which are arranged concentrically, wherein the ends of the bristles of the two partial groups 104 and 105 are disposed on a conical envelope surface.

Figure 38:
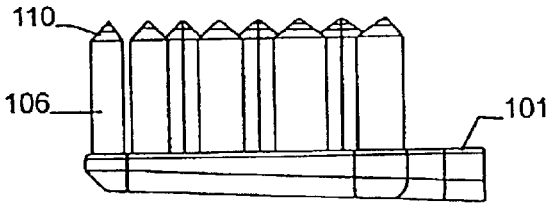
FIG. 38 shows a side view of FIG. 37.
Figure 37:
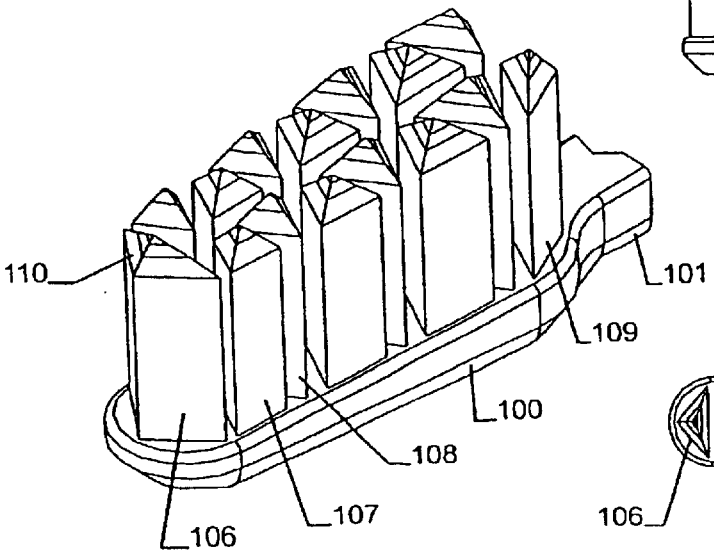
FIG. 37 shows a perspective partial view of a different embodiment of a tooth brush head.
Figure 39:
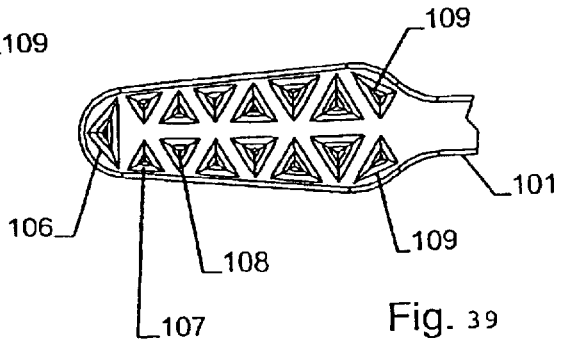
FIG. 39 shows a top view of FIG. 37.

FIGS. 37 to 39 show the head 100 and part of the neck 101 of a tooth brush. The head 100 is provided with bristle groups of essentially triangular cross-section, but with differing triangular shapes. The bristle group 106, disposed at the front end of the brush head, has an equilateral triangular cross-section. The bristle group consists of several partial groups, wherein the bristle ends of the partial groups are disposed on an envelope surface 110 of equilateral pyramid shape. The next two bristle groups 107 differ therefrom in that their cross-section is a triangle with differing side lengths. The next bristle groups 108 again have equilateral triangular cross-sections. The bristle groups 109 proximate the neck 101 have a cross-section corresponding to an extremely acute-angled triangle. The bristle ends of all partial groups are disposed on an envelope surface, as shown in FIG. 38, of equilateral or non-equilateral pyramid shape.

Figure 40:
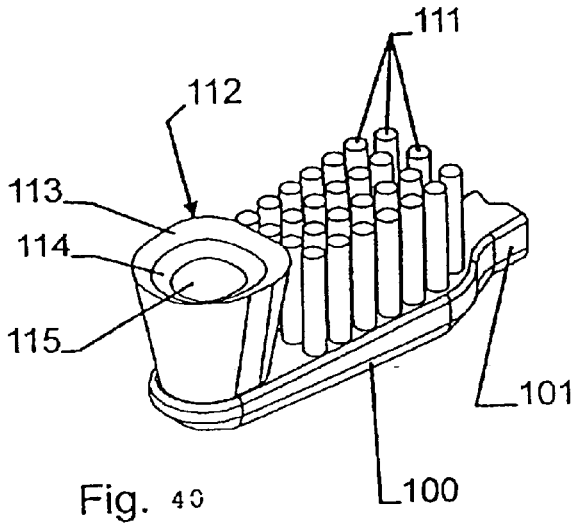
FIG. 40 shows a perspective partial view of a tooth brush head in a modified embodiment.
Figure 41:
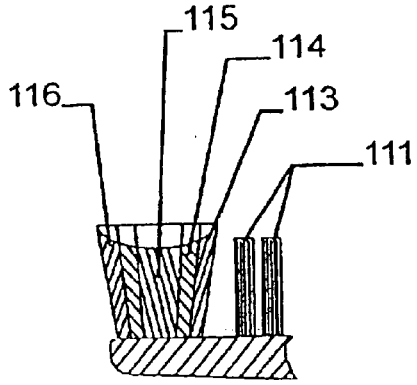
FIG. 41 shows a partial longitudinal section through the tooth brush head according to FIG. 40.

FIG. 40 shows a tooth brush head 100 whose bristle stock proximate the neck 101, consists of cylindrical bristle groups 111 and whose front area consists of a large volume bristle group 112. The cylindrical bristle groups 111 can be made from one single type of bristle or from two or more partial groups of different bristles. The bristle group 112 at the front end of the brush head 100 consists of three partial groups 113, 114 and 115 which are arranged in an essentially concentric manner with respect to one another and which expand in a cupped manner towards the bristle ends. The ends of the individual partial groups 113, 114, 115 lie on a convex envelope surface 116 (see FIG. 41).

Figure 42:
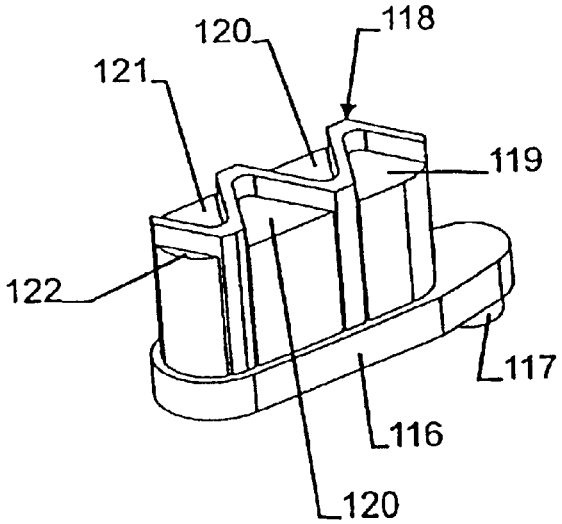
FIG. 42 shows a perspective partial view of a tooth brush head for an electric tooth brush.

The embodiment according to FIG. 42 shows an exchangeable head for an electric tooth brush. The head 116 comprises a pin 117 for mounting to the driving part of the electric tooth brush. The head 116 has bristle groups 118 to 122. The bristle group 118 extends in a zigzag shaped manner and has bristle ends protruding past the ends of the bristle groups 119 to 122. The bristles of the bristle group 118 and those of the groups 119 to 122 preferably consist of various types of bristles. The bristle group 118 can optionally be composed of several partial groups with bristles of the same or differing types.

Figure 43:
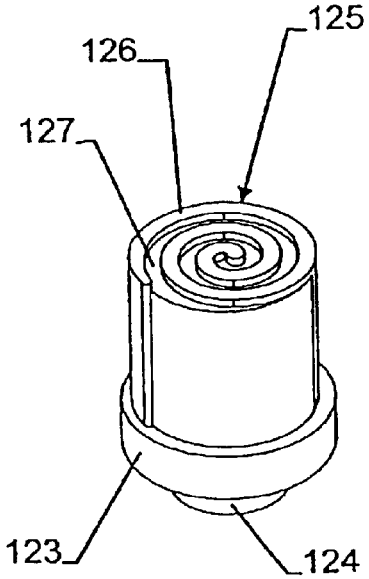
FIG. 43 shows a perspective view of a replaceable head for an electric tooth brush.

FIG. 43 also shows an exchangeable head 123 for an electric tooth brush which is mounted to the driving part of the electric tooth brush via a pin 124. The bristle stock consists of one single bristle group 125 composed of two partial groups 126 and 127, wherein the partial group 126 protrudes upwardly past the partial group 127 and its bristle ends lie on a spiral. The partial groups 126 and 127 can be composed of several partial groups of the same type of bristles.

Figure 44:
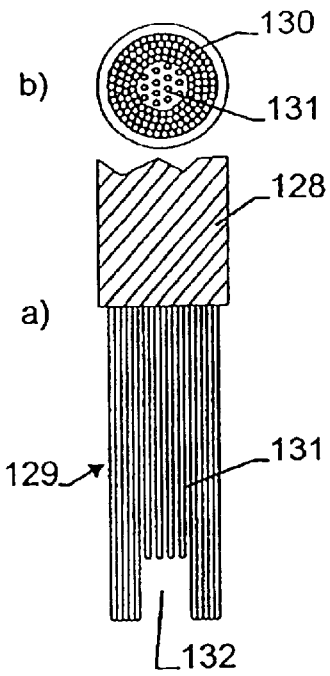
FIG. 44*a* shows a view of a first embodiment of an application brush.
FIG. 44*b* shows a top view of the first embodiment of an application brush.
Figure 45:
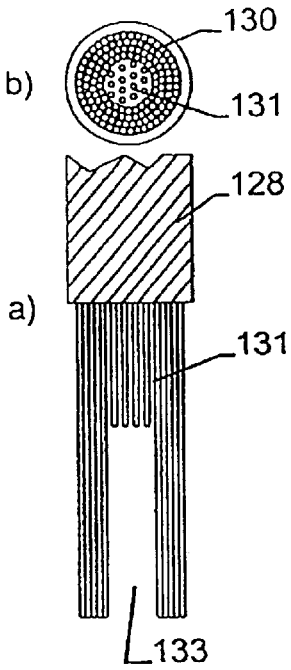
FIG. 45*a* shows a view of a second embodiment of an application brush.
FIG. 45*b* shows a top view of the second embodiment of an application brush.
Figure 46:
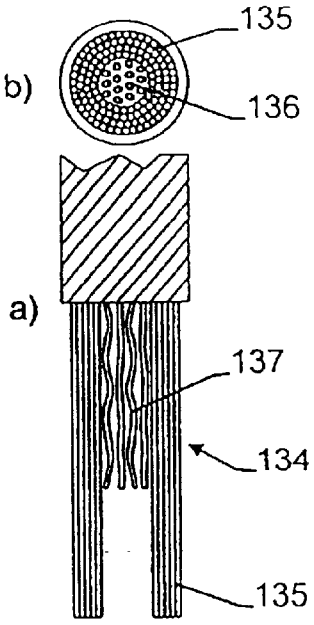
FIG. 46*a* shows a view of a third embodiment of an application brush.
FIG. 46*b* shows a top view of the third embodiment of an application brush.
Figure 48:
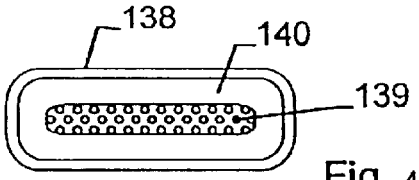
FIG. 48 shows a top view of the brush according to FIG. 43.

FIGS. 44 to 46 show various embodiments of a small application brush. In the embodiment according to FIG. 44, a bristle group 129 is mounted to a brush handle 128 and consists of two concentric partial groups 130 and 131 (FIG. 44*b*), wherein the central partial group 131 comprises shorter bristles to create a storage region 132 for the application means. The embodiment according to FIG. 46 differs from the one of FIG. 44 in that the central partial group 131 is somewhat shorter to create a larger storage region 133. In the embodiment of FIG. 46, the bristle group 134 consists of concentrically disposed partial groups 135 and 136, wherein the central partial group 136 consists of wavy bristles 137 (FIG. 46*a*) for additional storage of media which are likewise shorter than the bristles of the surrounding partial group 135.

Figure 47:
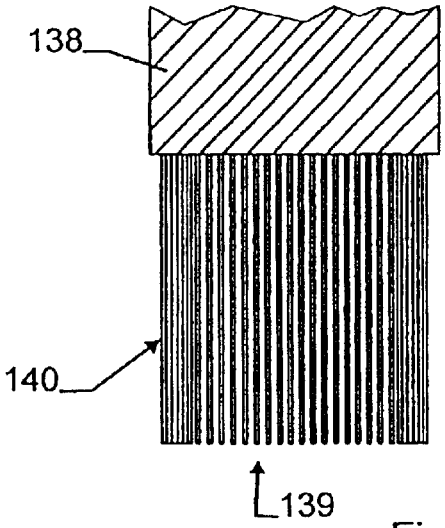
FIG. 47 shows a partial view of a brush.
Figure 49:
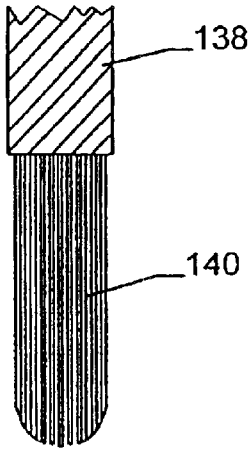
FIG. 49 shows a view of the brushes according to FIG. 47, rotated through 90°.

FIG. 47 shows a flat brush whose handle 138 supports a bristle group having a central partial group 139, surrounded in a circular manner by a partial group 140. The bristles of the central partial group 139 create intermediate, narrow capillaries for receiving paint or lacquer while the bristles of the outer partial group 140 are closely adjacent to one another and prevent lateral escape of the medium to be applied. A flat brush is thereby produced with which the medium can be applied in precise stripes.

What is claimed is:

1. A method for the production of brushes, the brushes consisting essentially of at least two different types of bristles collected into at least one combined bristle group having a defined cross section and mounted to a bristle support, the method comprising the steps of:

a) combining first bristles of a first bristle type into a first partial group;

b) combining second bristles of a second bristle type into a second partial group;

c) shaping said first partial group in a surrounding guide of a shaping device to obtain a first cross section corresponding to a first partial cross section of said first partial group in the combined bristle group;

d) shaping said second partial group in said surrounding guide of said shaping device to obtain a second cross section corresponding to a second partial cross section of said second partial group in the combined bristle group;

e) converging said shaped first and second partial groups while maintaining said first and said second partial cross sections to form a cross section of the combined bristle group; and f) mounting the combined bristle group to the bristle support.

2. The method of claim 1, wherein said first partial group comprises a first number of bristles which differs from a second number of bristles in said second partial group.

3. The method of claim 1, further comprising transferring, between steps e) and f), the combined bristle group to a holding means.

4. The method of claim 3, wherein said combined bristle group is clamped in said holding means.

5. The method of claim 4, wherein useful ends of bristles in said combined bristle group are clamped in said holding means and are subsequently one of mechanically treated and rounded.

6. The method of claim 3, wherein bristles in said holding means are displaced axially with respect to one another in an unclamped state to bring useful ends thereof into differing envelope surfaces.

7. The method of claim 6, wherein bristles of at least one of said first and said second partial group are displaced axially with respect to one another to bring useful ends of said bristles into differing envelope surfaces.

8. The method of claim 6, wherein ends of bristles to be fastened, which are opposite useful ends of said bristles, are prepared in said holding means for mounting to the bristle support.

9. The method of claim 1, wherein steps c) and d) comprise the steps of compressing each of said first and second partial groups.

10. The method of claim 1, further comprising simultaneously forming all bristle groups of a brush bristle stock in said shaping device.

11. The method of claim 10, further comprising transferring said all bristle groups of said brush bristle stock to a holding means, accommodating said all bristle groups.

12. The method of claim 1, further comprising sequentially forming all bristle groups of a brush bristle stock in said shaping device and transferring said all bristle groups to a holding means, accommodating said all bristle groups.

13. The method of claim 1, wherein said first partial group has a first length in said combined bristle group which differs from a second length of said second partial group in said combined bristle group, and further comprising transferring said combined bristle group to a holding means and cutting said combined bristle group flat at a location between said shaping device and said holding means.

14. The method of claim 1, wherein said first and said second partial groups are maintained at close separation when joined to form said combined bristle group.

15. The method of claim 1, wherein said first and said second partial group are tightly packed and combined to form said combined bristle group.

16. The method of claim 1, wherein bristles of each of said first and said second partial groups are made from endless monofilaments by accommodating bristles of a first type as first cords of first endless monofilament on a first spool and by accommodating bristles of a second type as second cords of second endless monofilaments on a second spool and by removing said first and said second cords from said first and said second spools and inserting said first and said second cords into said guide to form said first partial group from said first cords and said second partial group from said second cords, wherein bristles of all partial groups forming a combined bristle group are simultaneously supplied to said guide.

17. The method of claim 1, wherein each of said first and said second partial groups is made from short-cut bristles of appropriate length.

18. A device for carrying out the method of claim 1, the device comprising:

a first spool for storing first monofilament cords of a first bristle type;

a second spool for storing second monofilament cords of a second bristle type;

at least one downstream drawing device having one guiding channel for each of said first and said second monofilament cords;

a shaping device disposed downstream of said drawing device, said shaping device having channels corresponding to a number of guiding channels in said drawing device, said shaping channels having openings facing said drawing device which are aligned with said guiding channels and which have cross-sections changing into a respective partial cross-section of a respective partial group towards an opposing opening, while converging into an envelope cross-section corresponding to a cross-section of said combined bristle group, wherein said first and second cords can be removed from said first and second spools and pushed through said shaping device via linear motion of said drawing device.

19. The device of claim 18, further comprising a moveable holding means for at least one combined bristle group, said holding means disposed downstream of said shaping device and having holding channels whose shape and arrangement correspond to facing shaping channels of said shaping device, wherein partial groups formed in said shaping device and combined into said combined bristle group can be transferred to said holding means, and further comprising a cutting device disposed between said shaping device and said holding means for cutting said combined bristle group in said holding means to a desired length, wherein said holding means, with said combined bristle group, can be transported for mounting said combined bristle group to the bristle support.

20. The device of claim 19, wherein at least two separately moveable drawing devices are disposed, one behind the other, and act on said first and said second cords forming said first and said second partial groups to insert said first and said second partial groups into said holding means.

21. The device of claim 19, wherein said drawing device and said holding means each comprise parallel layered plates at least one of which can be moved as a clamping plate transverse to said guiding and said holding channels to clamp said first and said second partial groups.

22. The device of claim 21, wherein bristles of at least one of said combined bristle group, said first partial group and said second partial group can be displaced axially relative to one another when said clamping plate is released.

23. The device of claim 19, wherein said holding means, with a clamped said combined bristle group, can be moved past devices for at least one of processing and treatment of at least one of useful ends and fastening ends of bristles in said combined bristle group.

24. The device of claim 18, wherein said shaping channels of said shaping device have a cross-sectional area which decreases in a direction of cross-sectional variation.

* * * * *